US007965175B2

(12) United States Patent
Yamano

(10) Patent No.: US 7,965,175 B2
(45) Date of Patent: Jun. 21, 2011

(54) SOUNDER

(75) Inventor: Naoto Yamano, Kent (GB)

(73) Assignee: Hochiki Corporation, Tokyo (JP)

( * ) Notice: Subject to any disclaimer, the term of this patent is extended or adjusted under 35 U.S.C. 154(b) by 271 days.

(21) Appl. No.: 11/914,110

(22) PCT Filed: May 10, 2005

(86) PCT No.: PCT/JP2005/008544
§ 371 (c)(1),
(2), (4) Date: Feb. 9, 2008

(87) PCT Pub. No.: WO2006/120732
PCT Pub. Date: Nov. 16, 2006

(65) Prior Publication Data

US 2009/0051508 A1 Feb. 26, 2009

(51) Int. Cl.
*G08B 3/00* (2006.01)

(52) U.S. Cl. ..... 340/384.1; 340/384.4; 340/384.7

(58) Field of Classification Search ..... 340/384.1, 340/384.7
See application file for complete search history.

(56) References Cited

U.S. PATENT DOCUMENTS

| | | | | |
|---|---|---|---|---|
| 5,635,903 | A * | 6/1997 | Koike et al. | 340/441 |
| 6,362,726 | B1 | 3/2002 | Chapman | |
| 2002/0135491 | A1 | 9/2002 | Maier, Jr. | |
| 2003/0006885 | A1 * | 1/2003 | Rey | 340/384.6 |

FOREIGN PATENT DOCUMENTS

| | | |
|---|---|---|
| DE | 3505478 | 8/1986 |
| DE | 3505478 A1 | 8/1986 |
| JP | 7-182587 | 7/1995 |
| JP | 10-255184 | 9/1998 |
| JP | 2002-279565 | 9/2002 |
| WO | WO 98/11666 | 3/1998 |

OTHER PUBLICATIONS

Extended European Search Report issued by European Patent Office dated Nov. 11, 2010.
Chinese Patent Office, The first Office Action for Chinese Patent Application No. 201010170247.X, Feb. 1, 2011.

* cited by examiner

*Primary Examiner* — Travis R Hunnings
(74) *Attorney, Agent, or Firm* — Sherr & Vaughn, PLLC

(57) ABSTRACT

To provide a sounder that outputs alarm sound to notify an abnormality in a monitored region. The sounder includes: a sound source that outputs alarm sound when a pulse signal is applied to the sound source; a pulse signal application unit that applies the pulse signal to the sound source; a storage unit that stores plural combinations of a frequency and a pulse width that the pulse signal can take; and a pulse signal control unit that controls the pulse signal application unit so that the pulse signal corresponding to the combination of the frequency and the pulse width stored in the storage unit is applied to the sound source.

8 Claims, 17 Drawing Sheets

[FIG. 1]
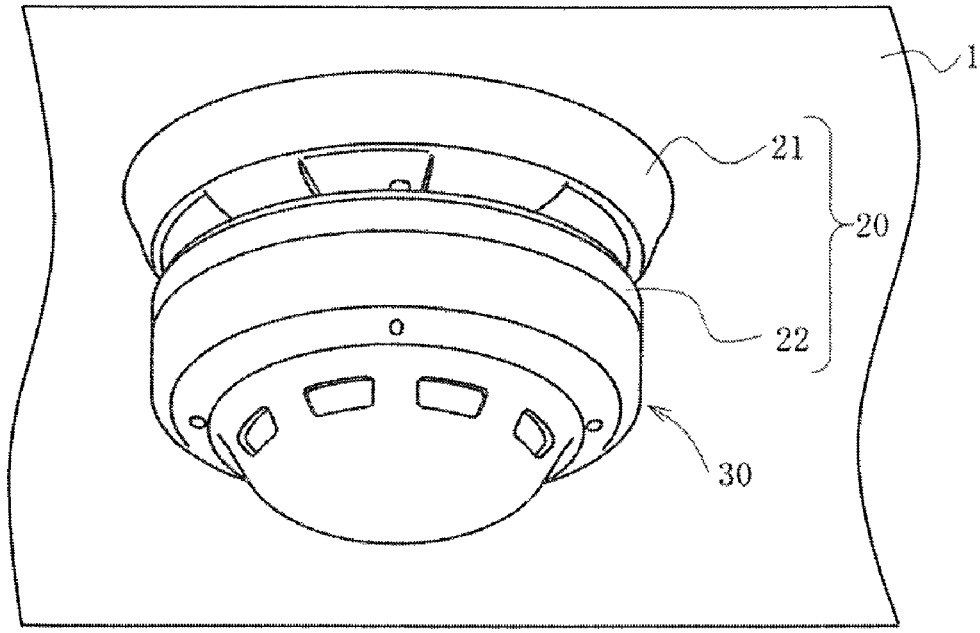

[FIG. 2]
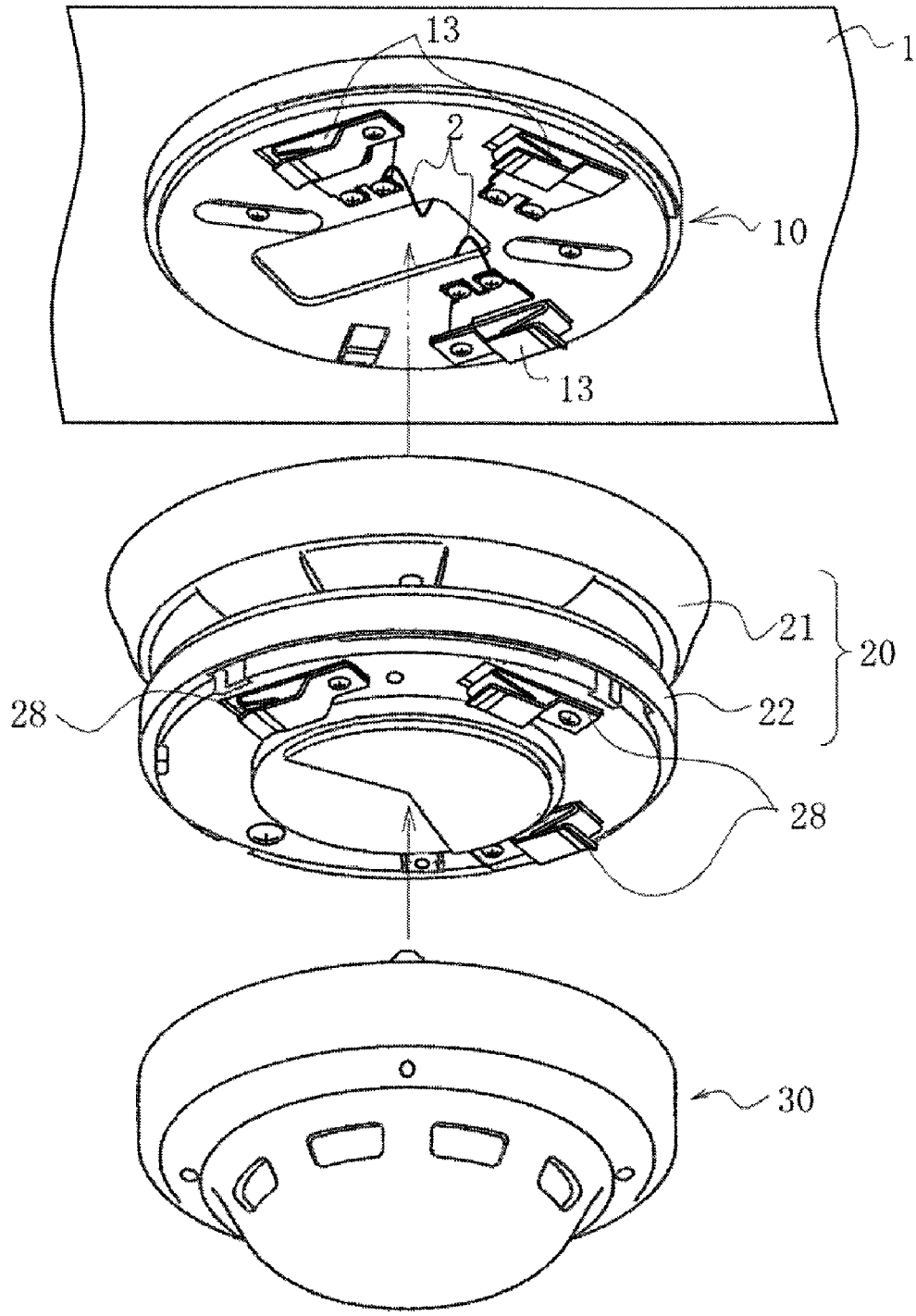

[FIG. 3]
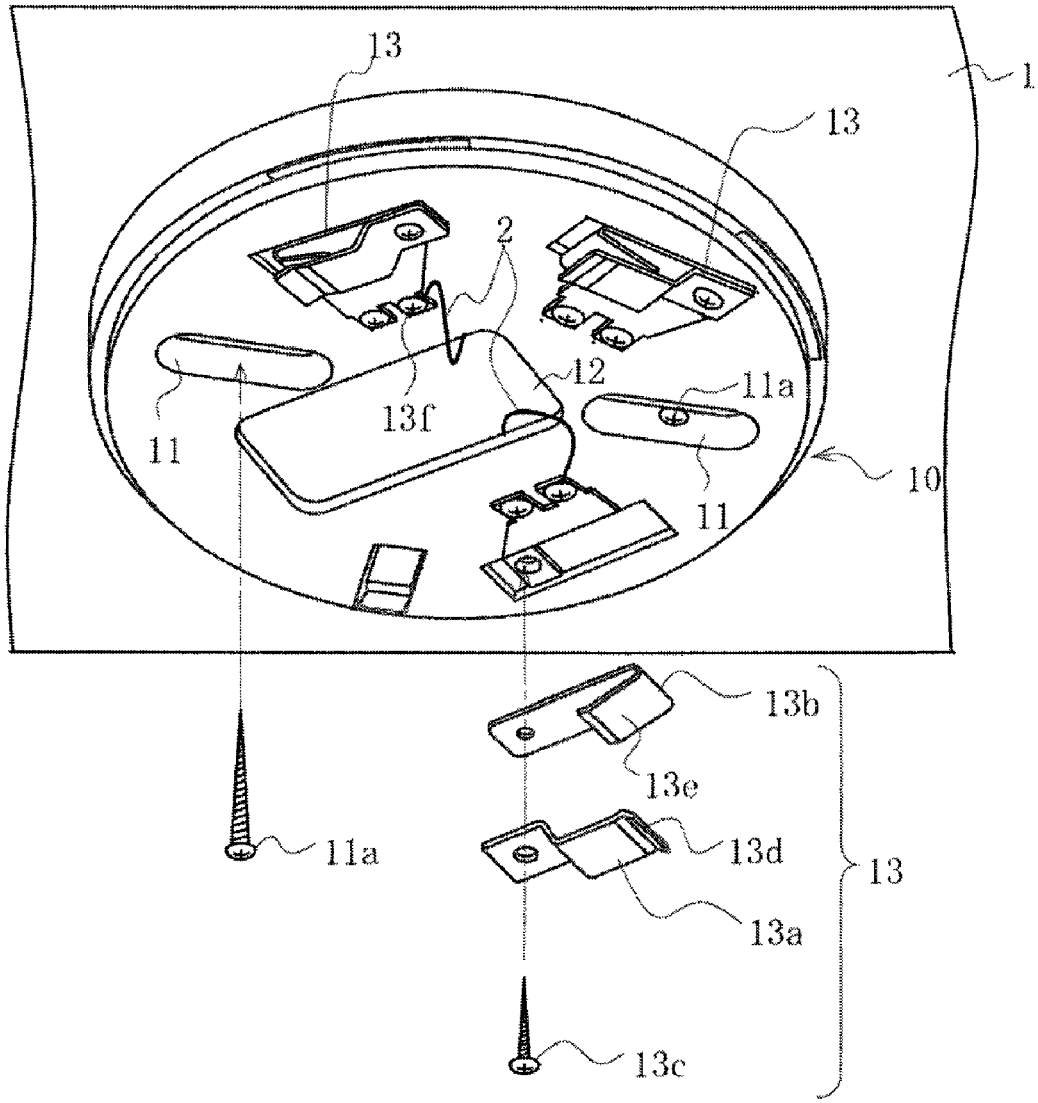

[FIG. 4]
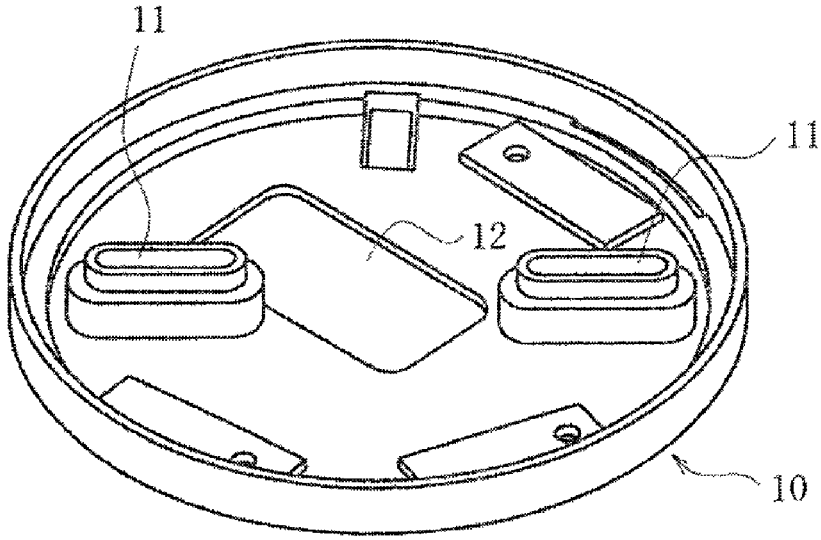

[FIG. 5]
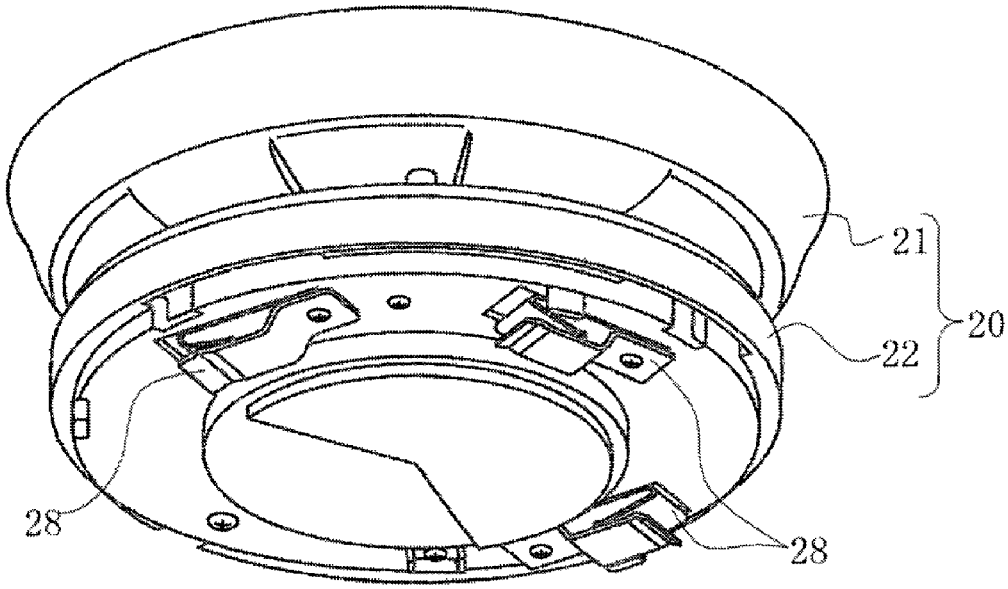

[FIG. 6]
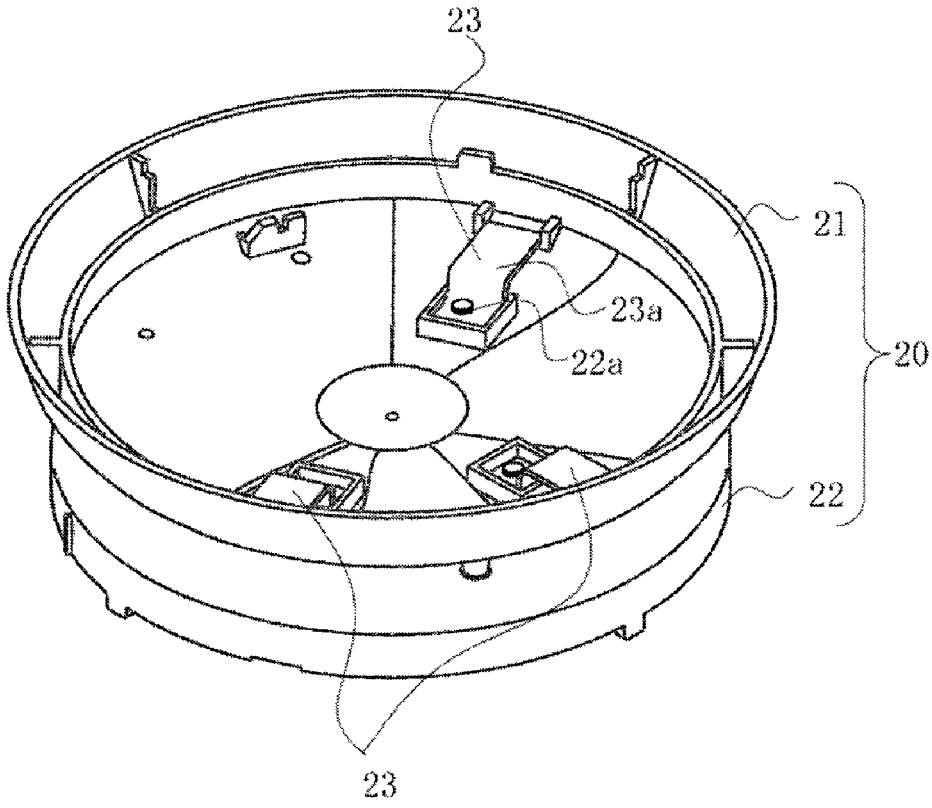

[FIG. 7]
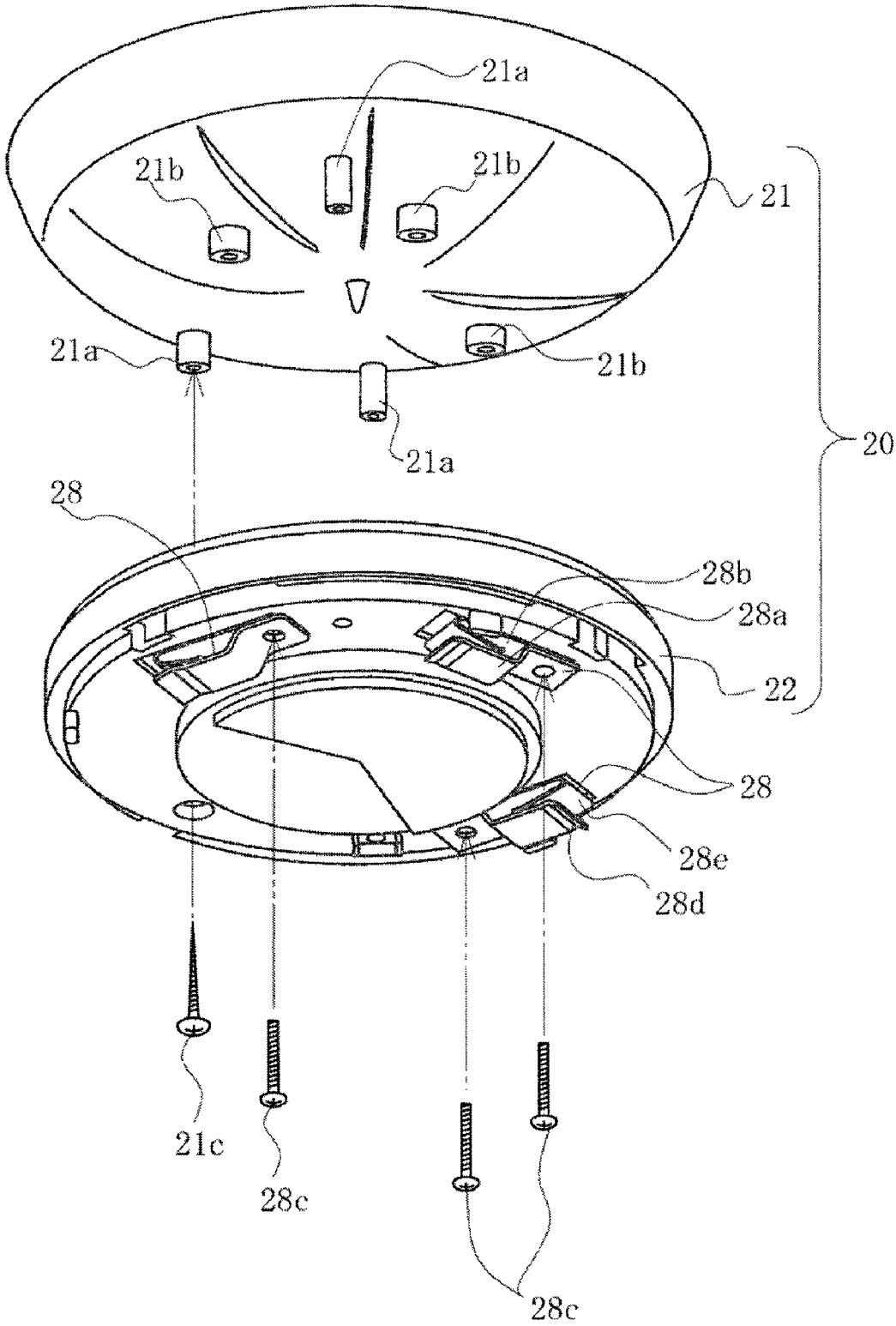

[FIG. 8]
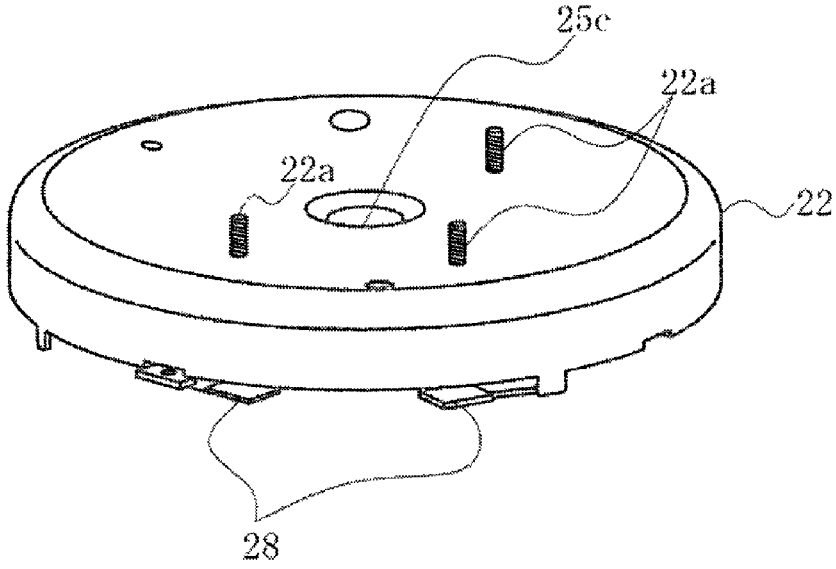

[FIG. 9]
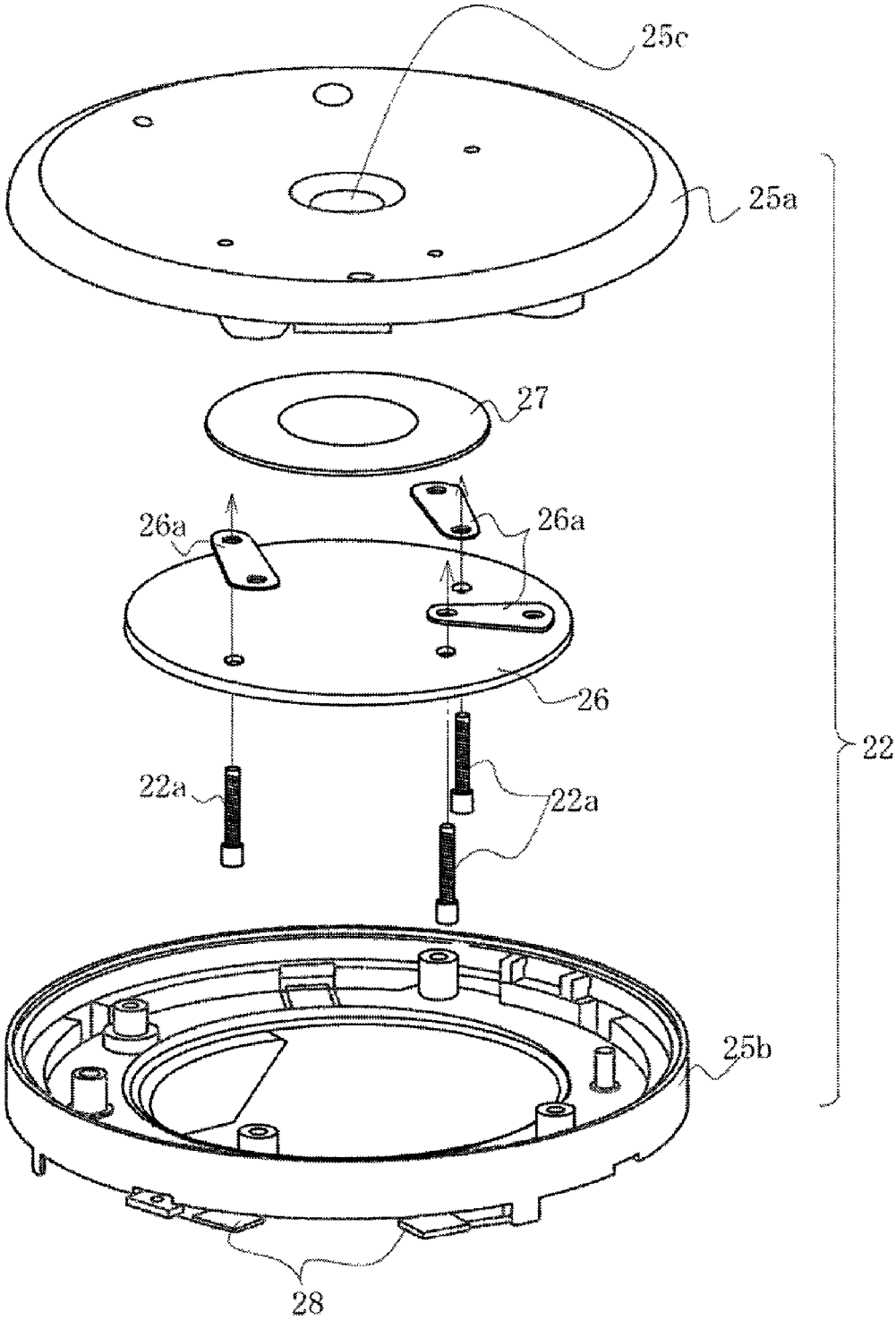

[FIG. 10]
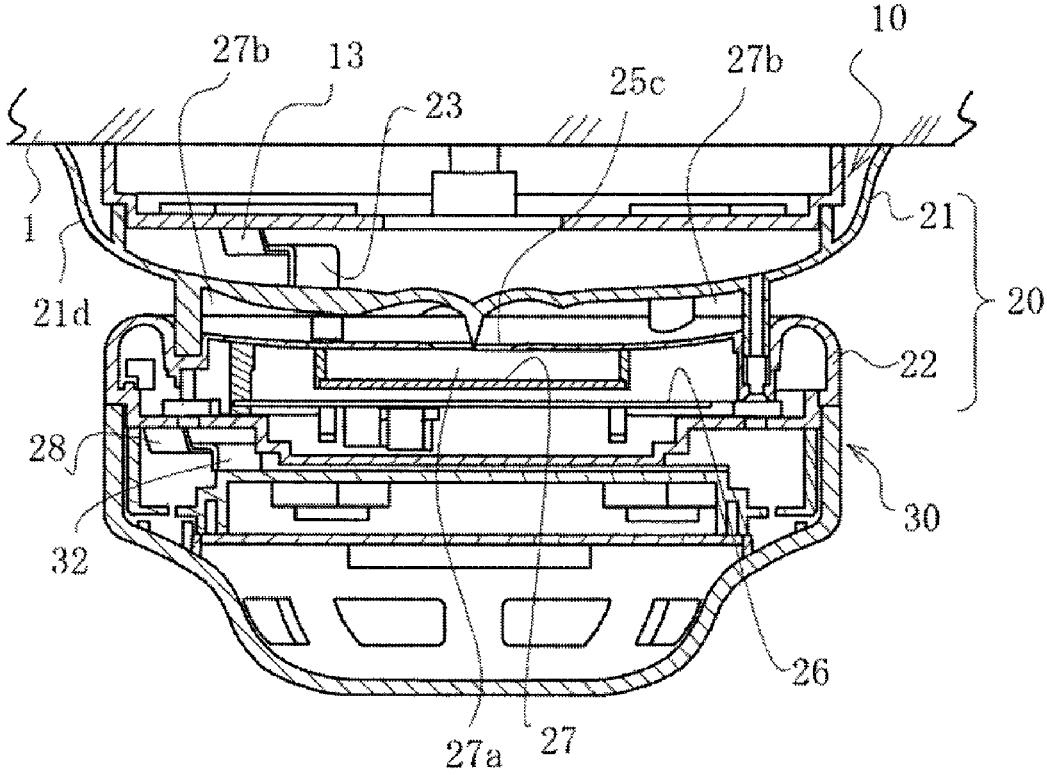

[FIG. 11]
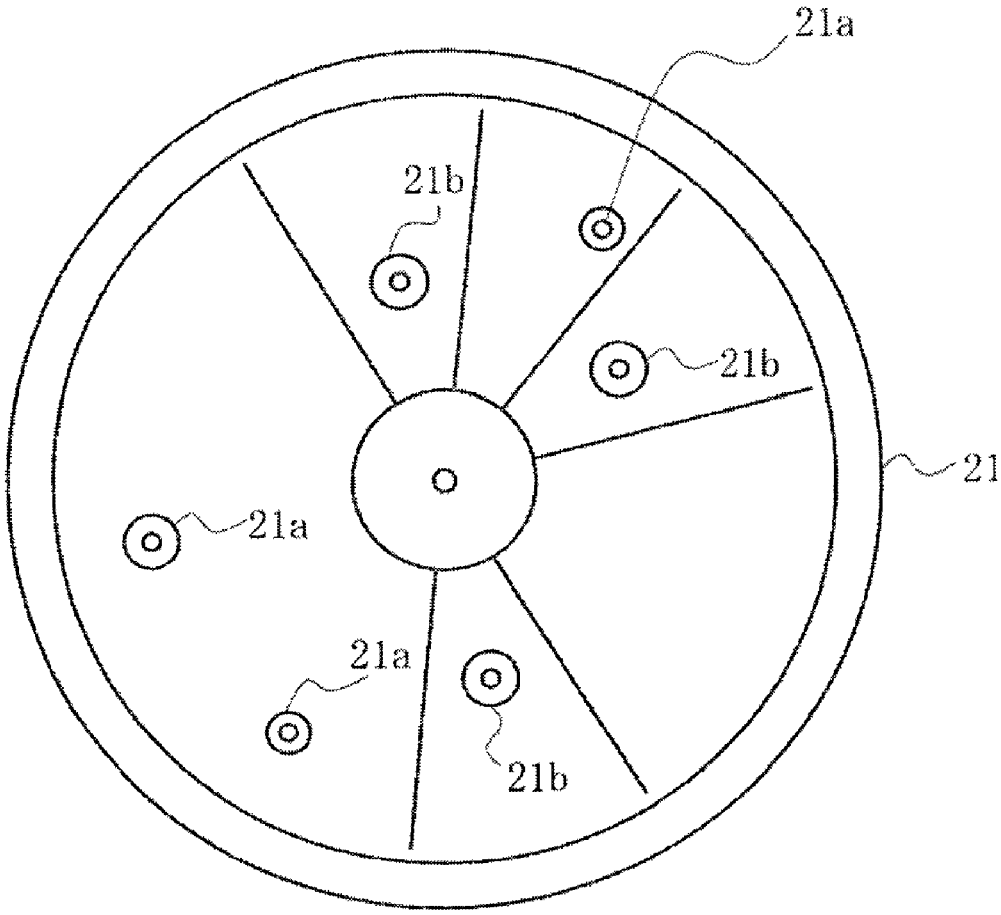

[FIG. 12]
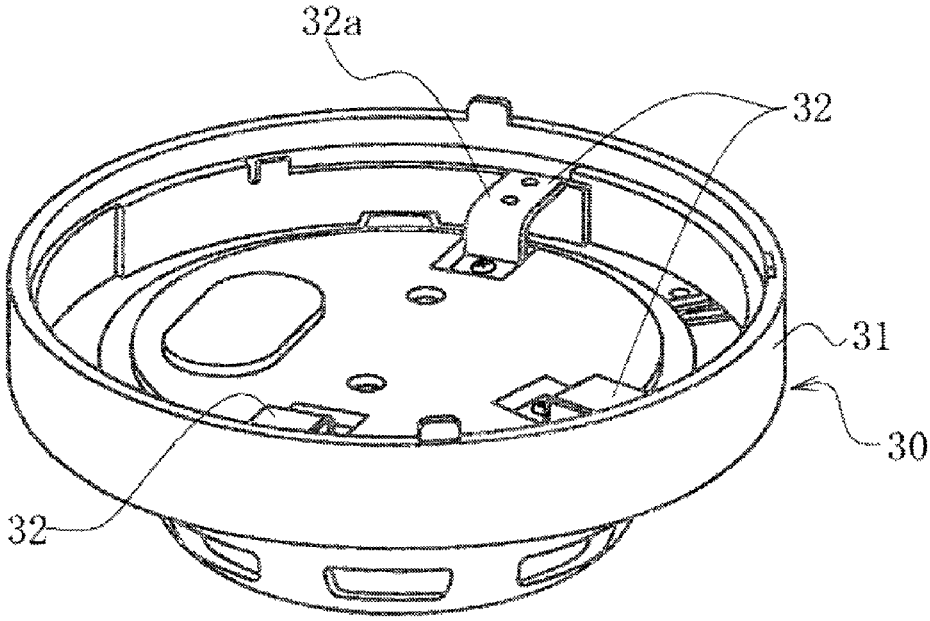

[FIG. 13]
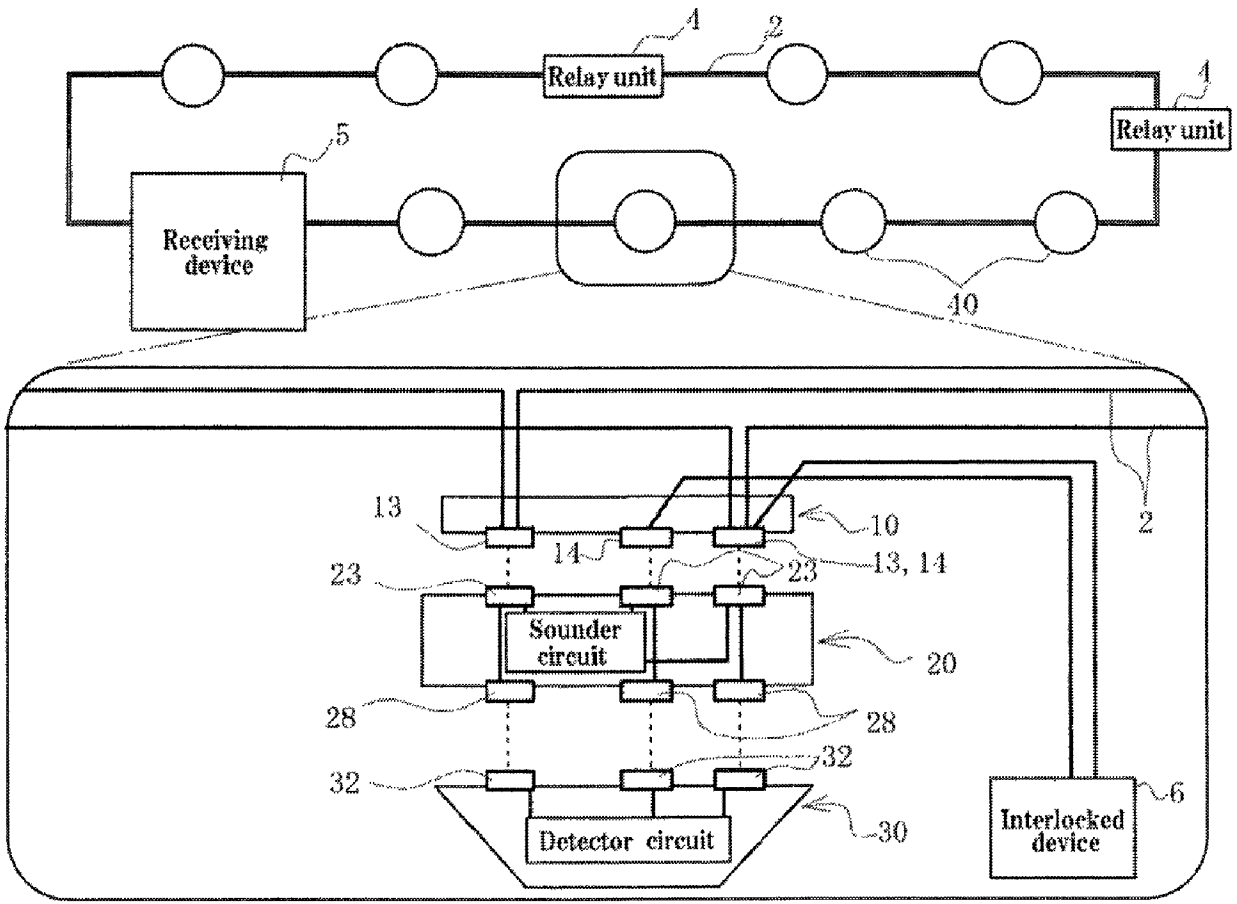

[FIG. 14]
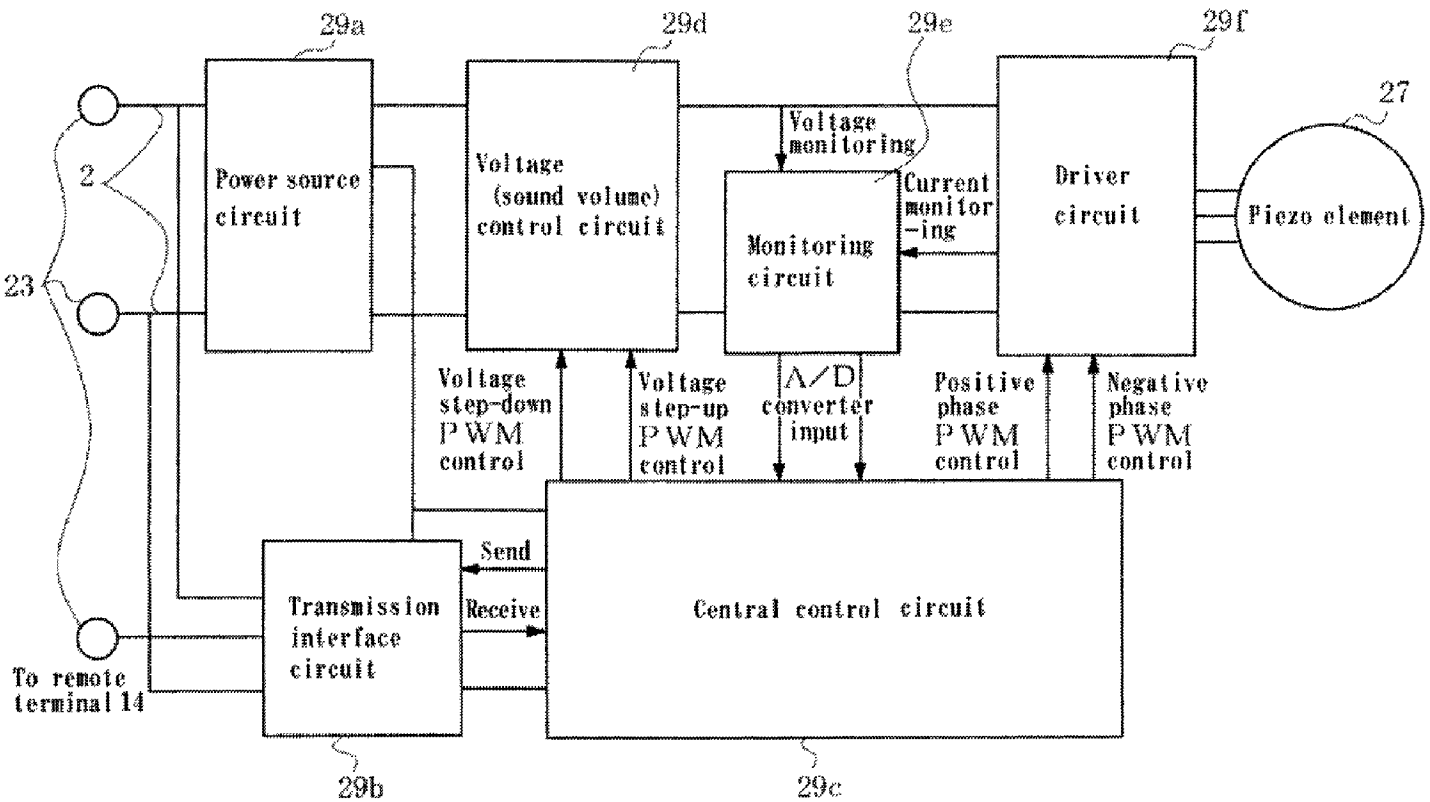

[FIG. 15]
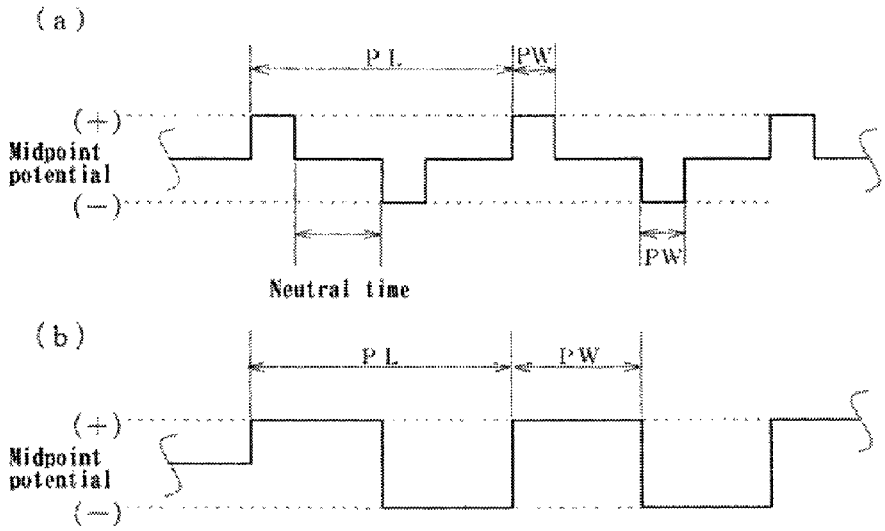

[FIG. 16]
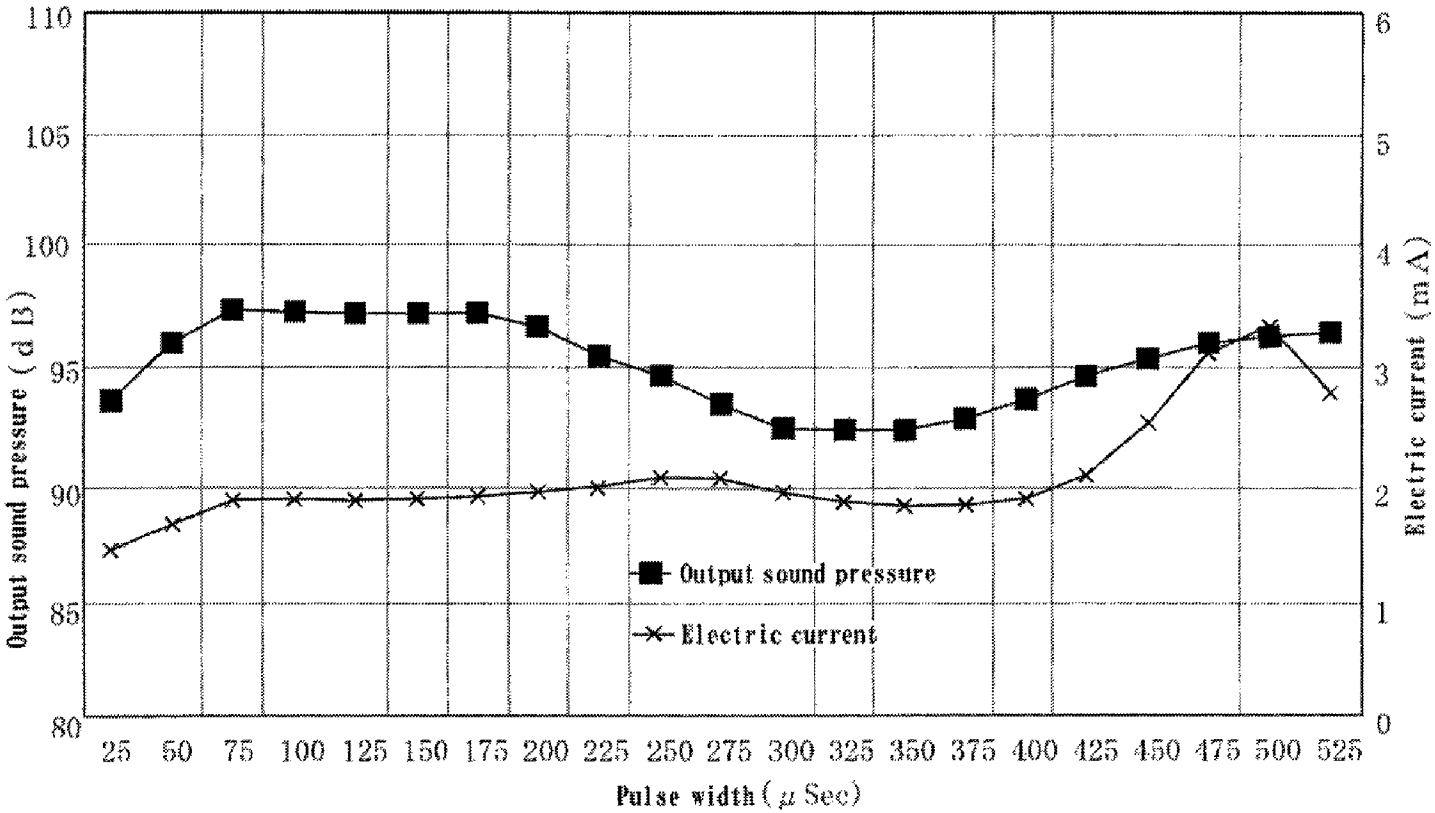

[FIG. 17]
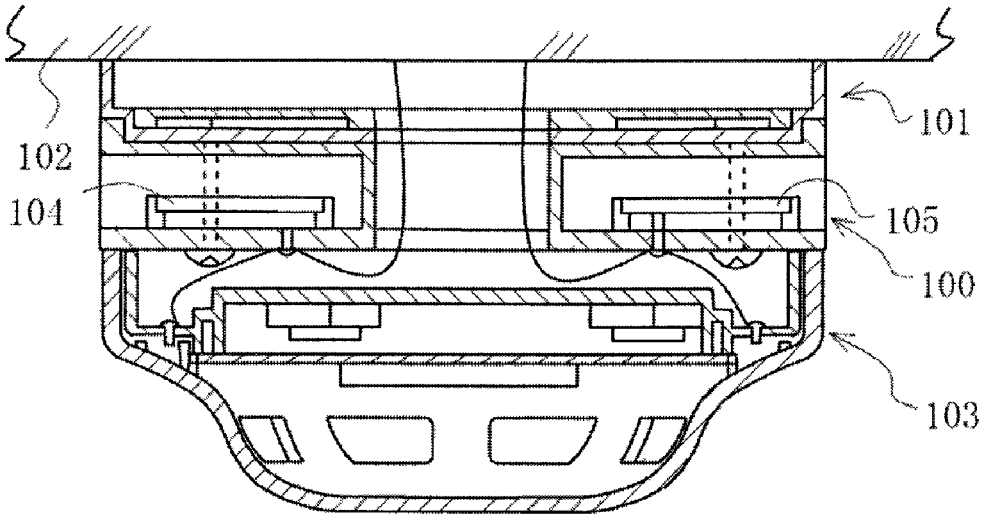

SOUNDER

TECHNICAL FIELD

The present invention relates to a sounder fitted to an alarm device that gives an alarm by detecting various kinds of abnormalities such as fires, and outputs an alarm to notify the occurrence of an abnormality, based on the output from the alarm device.

BACKGROUND ART

In order to save a building and human lives from house fire, it is effective to install a fire detector that detects the occurrence of fire at an early stage and gives an alarm. For this purpose, when the fire detector installed in a monitored region detects fire, the fire detector outputs an alarm signal to sound an alarm bell or an alarm speaker, thereby notifying the occurrence of fire.

However, in a building having high sound insulation such as a hotel, even when the alarm bell installed on an access is sounded, the alarm sound is not easily audible by users within living rooms. To solve this inconvenience, a sounder (a base sounder) that is directly fitted to the fire detector within the living room and generates alarm sound based on the output from the fire detector is put into practical use. For example, U.S. Pat. No. 6,362,726 discloses a base sounder that can be fitted to a fire alarm system. According to such base sounder, the alarm sound can be output at the same position as the fire detector within the living room, thereby more securely achieving the fire alarm.

A configuration of the above conventional base sounder is explained. FIG. 17 is a vertical cross-sectional view of the conventional sounders installed on the ceiling surface. As shown in FIG. 17, the conventional base sounder 100 is fitted to a ceiling surface 102 via a fitting base 101. A fire detector 103 is connected to a lower end of the base sounder 100. Electric constituent elements such as a circuit substrate 104 and a piezo element 105 are accommodated inside the base sounder 100. Alarm sound output from the piezo element 105 is discharged to the outside of the base sounder 100.

Output control of the conventional base sounder is explained below. In general, the base sounder using the piezo element 105 for the sound source outputs alarm sound by applying a pulse signal to the piezo element 105. Specifically, plural MOS-FETs (Metal Oxide Semiconductor Field Effect Transistors) (not shown) are combined to configure a driver circuit of a full bridge. A pulse signal having a constant width generated by a pulse switching using this driver circuits is applied to the piezo element 105.

Alarm sound is sometimes desired to be output in different sound volumes and at different pitches according to kinds of alarm and urgency levels. For example, when a fire detector is connected to plural other fire detectors linked to each other, the fire detector outputs alarm sound in a relatively high tone when the fire detector itself has detected fire, and the fire detector outputs alarm sound in a relatively low tone when the fire detector notifies fire detected by other fire detector. In order to output plural alarm sounds, the conventional base sounder simply changes the amplitude and the frequency of a pulse signal applied to the piezo element 105.

Patent Document 1: U.S. Pat. No. 6,362,726

DISCLOSURE OF THE INVENTION

Problems to be Solved by the Invention

However, the conventional base sounder simply changes the amplitude and the frequency of the pulse signal to output plural alarm sounds, and does not carry out any control of a pulse width of the pulse signal. Therefore, the output efficiency of the alarm sound decreases. In other words, the sound volume level (sound pressure) of the alarm sound output from the piezo element can be changed according to the amplitude, the frequency, and the pulse width of the pulse signal applied to the piezo element. However, conventionally, only the amplitude and the frequency of the pulse signal are changed. Therefore, the pulse width of the pulse signal is not at an optimum value to increase the sound pressure in this frequency. Accordingly, the output efficiency of the alarm sound decreases in some cases. When only the amplitude is increased, the sound pressure increases, but the current consumption increases and the output efficiency decreases.

The present invention has been achieved in view of the above conventional problems of the sounder, and has an object of providing a sounder that increases the output efficiency of alarm sound, by applying a pulse signal suitable for each situation to the piezo element.

Effects of the Invention

The sounder according to the present invention can apply a pulse signal having a desired frequency and pulse width to the sound source. Therefore, the acoustic efficiency of the sound source can be intentionally operated to improve the acoustic efficiency.

The sounder according to the present invention can also specify a pulse width to output alarm sound in high efficiency by matching a desired frequency when this frequency is first specified. Therefore, the acoustic efficiency of the sound source can be intentionally operated to improve the acoustic efficiency.

The sounder according to the present invention can also decrease current consumption of the sound source from the consumption when the pulse duty ratio is 50%. Therefore, the sound source can be driven in power saving mode to further improve the acoustic efficiency.

BRIEF DESCRIPTION OF THE DRAWINGS

FIG. 1 is a perspective view showing a base sounder according to a first embodiment of the present invention together with a fire detector.

FIG. 2 is an exploded perspective view of the base sounder and the like shown in FIG. 1.

FIG. 3 is an enlarged perspective view of a fitting base observed from below.

FIG. 4 is an enlarged perspective view of a fitting base observed from above.

FIG. 5 is an enlarged perspective view of a base sounder observed from below.

FIG. 6 is an enlarged perspective view of a base sounder observed from above.

FIG. 7 is an exploded perspective view of the base sounder.

FIG. 8 is an enlarged perspective view of a sounder body observed from above.

FIG. 9 is an exploded perspective view of FIG. 8.

FIG. 10 is a vertical cross-sectional view showing the base sounder together with the fire detector.

FIG. 11 is a top plan view of a base cover observed from below.

FIG. 12 is a perspective view of the fire detector observed from above.

FIG. 13 is a system diagram showing an electric configuration of a fire notification system including the base sounder.

FIG. 14 is a block diagram showing a functional outline of the electric configuration of the base sounder.

FIG. 15 is a view showing a pulse signal, where (a) shows a pulse signal in an embodiment, and (b) shows a conventional pulse signal.

FIG. 16 is a graph showing a relationship between a pulse width of a pulse signal applied to a piezo element in a specific frequency, a current value of the pulse signal, and an output sound pressure of alarm sound output from the piezo element.

FIG. 17 is a vertical cross-sectional view of the conventional base sounder and the like installed on the ceiling surface.

DESCRIPTION OF REFERENCE NUMERALS

1, 102 Ceiling surface
2 Lead wire
3 Wall surface
4 Terminal device
5 Receiving device
10, 101 Fitting base
11 Screw hole
11*a*, 13*c*, 21*c*, 22*a*, 28*c*, 32*b* Screw
12 Wiring hole
13 Base-side connection terminal
13*a*, 13*b*, 23*a*, 28*a*, 28*b*, 32*a* Plate
20, 100 Base sounder
21 Base cover
21*a*, 21*b* Interlocked pole
22 Sounder body
23 Output device-side connection terminal
25*c* Sound discharge opening
26, 104 Circuit substrate
26*a* Metal
27, 105 Piezo element
27*a* Resonance space
27*b* Amplifying space
28 Second output device-side connection terminal
29*a* Power source circuit
29*b* Transmission interface circuit
29*c* Central control circuit
29*d* Voltage (sound volume) control circuit
29*e* Monitoring circuit
29*f* Driver circuit
30, 103 Fire detector
32 Alarm device-side connection terminal

BEST MODES FOR CARRYING OUT THE INVENTION

Embodiments of the present invention are explained below. Each embodiment relates to a sounder, and the sounder is connected to an alarm device that detects an abnormality in a monitored region. Each embodiment relates to the sounder (hereinafter, referred to as "base sounder") that receives the input of a signal output from the alarm device and outputs alarm sound, when the alarm device has detected an abnormality and the like.

In this case, a specific content of a region and an object monitored by the alarm device connected to the base sounder are optional. For example, a fire detector that detects fire, a gas leakage detector that detects a gas leakage, and a composite fire and a gas-leakage detector that detects both fire and gas are the objects to be monitored.

The base sounder according to the present embodiment can be fitted to an optional installation surface, and can be installed on the ceiling surface and the wall surface, for example. The base sounder can output alarm sound at plural pitches by controlling the sound source. Particularly, the base sounder has a part of a main characteristic in the control system of the sound source. With this arrangement, the base sounder can output alarm sound in high efficiency each time of outputting the alarm sound at any pitch. In other words, the sound pressure to the input current is improved by optimizing the combination of the frequency and the pulse width of the pulse signal applied to the sound source.

First, a configuration of each part is explained. FIG. 1 is a perspective view showing the base sounder according to the present embodiment together with the fire detector, and FIG. 2 is an exploded perspective view of the base sounder and the like shown in FIG. 1. As shown in these drawings, a fitting base 10 is fixed to a ceiling surface 1 as the installation surface, and a base sounder 20 is fitted to a lower part of the fitting base 10. A fire detector 30 is connected to a further lower part of the base sounder 20. In other words, the base sounder 20 is disposed to be sandwiched between the fitting base 10 and the fire detector 30. In the present embodiment, for the convenience of the explanations, a direction approaching the ceiling surface 1 from the base sounder 20 is called "above", and a direction leaving away from the ceiling surface 1 is called "below", when necessary. When a surface other than the ceiling is set as an installation surface, the "above" can be regarded as a direction of approaching the installation surface, and "down" can be regarded as a direction of leaving away from the installation surface.

FIG. 3 is an enlarged perspective view of the fitting base looked at from below. The fitting base 10 is formed approximately in a plate shape as a whole. When a screw 11*a* is inserted into a screw hole 11 and is screwed into the ceiling surface 1, the fitting base 10 can be fixed to the ceiling surface 1. A lead wire 2 led from the ceiling surface 1 can be inserted into a wiring hole 12, and drawn toward a base-side connection terminal 13. The base-side connection terminal 13 functions as a connecting unit that receives power from the lead wire 2, inputs and outputs a signal to and from the base sounder 20 or the fire detector 30, and structurally connects the fitting base 10 and the base sounder 20 or the fire detector 30. Specifically, by sandwiching a plate 23*a* of an output device-side connection terminal 23 described later of the base sounder 20 into between two plates 13*a* and 13*b* configuring the base-side connection terminal 13, the base sounder 20 can be structurally and electrically fixed to the fitting base 10. Alternatively, by sandwiching a plate 32*a* of an alarm device-side connection terminal 32 described later of the fire detector 30 into between the two plates 13*a* and 13*b*, the fire detector 30 can be structurally and electrically fixed to the fitting base 10. The end part of the core line of the lead wire 2 led from the ceiling surface 1 is fixed to the fitting base 10 with a screw 13*f* electrically communicated to the base-side connection terminal 13.

The base sounder 20 is explained next. FIG. 5 is an enlarged perspective view of the base sounder looked at from below, and FIG. 6 is an enlarged perspective view of the base sounder looked at from the above. As shown in these drawings, in outline, the base sounder 20 is configured to include a base cover 21 and a sounder body 22.

Of the above, the base cover 21 covers approximately the whole of the fitting base 10 to improve design, dust prevention, and acoustic characteristic, by not exposing the fitting base 10 to the outside. The output device-side connection terminals 23 are provided on the upper surface of the base cover 21. Each output device-side connection terminal 23 is a connecting unit to receive power from the fitting base 10 and to input and output a signal to and from the fitting base 10. The output device-side connection end 23 also functions as a connecting unit to structurally connect the base sounder 20 to the fitting base 10. Specifically, the output device-side connection terminal 23 can have the base sounder 20 structurally and electrically fixed to the fitting base, by sandwiching the plate 23*a* configuring the output device-side connection terminal 23 between the two plates 13*a* and 13*b* of the base-side connection terminal 13 shown in FIG. 3.

The sounder body 22 is explained next. FIG. 8 is an enlarged perspective view of the sounder body looked at from the above, FIG. 9 is an exploded perspective view of FIG. 8, and FIG. 10 is a vertical cross-sectional view showing the base sounder together with the fire detector. The sounder body 22 accommodates main electric structural elements of the base sounder 20. Specifically, a circuit substrate 26 is accommodated within the sounder body 22. Electric structural elements of the base sounder 20, such as a central control unit and a power control unit (not shown), for example, are disposed on the circuit substrate 26. A piezo element 27 as a sound source of alarm sound is disposed at an upper position at approximately the center of the plane surface of the sounder body 22. The piezo element 27 is electrically connected to the circuit substrate 26. When a voltage is applied to the piezo element 27, the piezo element 27 is expanded and contracted to generate alarm sound.

Referring back to FIGS. 5 and 7, a second output device-side connection terminal 28 is provided on the lower surface of the sounder body 22. The second output device-side connection terminal 28 is a connecting unit to supply power to the fire detector 30 shown in FIG. 1 and to input and output a signal to and from the fire detector 30. The second output device-side connection terminal 28 also functions as a connecting unit to structurally and electrically connect the sounder body 22 to the fire detector 30. The position and the shape of the second output device-side connection terminal 28 of the sounder body 22 are approximately the same as the position and the shape of the base-side connection terminal 13 of the fitting base 10. Plates 28*a* and 28*b* configuring the second output device-side connection terminal 28 are fastened with screws 28*c*. The plate 32*a* of the detector-side connection terminal 32 described later is sandwiched between the plates 28*a* and 28*b*, thereby structurally and electrically fixing the fire detector 30 to the base sounder 20.

A mutual interlock structure between the base cover 21 and the sounder body 22 having the above configuration is explained next. FIG. 11 is a top plan view of the base cover looked at from below. As shown in FIG. 11, plural interlocked poles 21*a* and 21*b* in a hollow cylindrical shape extending toward the sounder body 22 are integrally provided on a side surface (a lower surface) facing the sounder body 22, out of both side surfaces of the base cover 21. Out of the plural interlocked poles 21*a* and 21*b*, a part of the interlocked poles 21*a* facilitates positioning at the manufacturing time, and also functions as a hole to extract water when water drips from the back of the ceiling are pooled on the base cover and to insert a lock mechanism cancellation pin of the fitting base from the alarm device side.

The other interlocked poles 21*b* are formed at a position approximately corresponding to the plane surface position of the output device-side connection terminal 23 shown in FIG. 6 and the plane surface position of the second output device-side connection terminal 28 shown in FIG. 7. On the other hand, as shown in FIGS. 8 to 11, the sounder body 22 is provided with screws 22*a* electrically connected from the circuit substrate 26, and the screws 22*a* pass through the upper casing 25*a* and are stretched upward. The screws 22*a* are inserted into the interlocked poles 21*b* shown in FIG. 7, and one end of each screw 22*a* is electrically connected to each output device-side connection terminal 23. The screw 28*c* electrically connects the second output device-side connection terminal 28 to a tag 26*a* extending from the circuit substrate 26. Based on this structure, the output device-side connection terminal 23, the screw 22*a*, and the second output device-side connection terminal 28 are electrically connected. In the base sounder 20 having the above configuration, as shown in FIG. 10, alarm sound output from the piezo element 27 is amplified by a resonance space 27*a*. The alarm sound reaches an amplifying space 27*b* via a sound discharge opening 25*c*, is amplified in the amplifying space 27*b*, and is output to the outside of the base sounder 20.

The fire detector 30 is explained next. The fire detector 30 can be configured approximately in the same manner as that of the conventional fire detector except a part specifically described. Explanations of the configuration approximately the same as that of the conventional fire detector will be omitted. FIG. 12 is a perspective view of the fire detector looked at from the above. As shown in FIG. 12, the alarm device-side connection terminal 32 is provided on the upper surface of the fire detector 30. The alarm device-side connection terminal 32 is a connecting unit that supplies power to the fire detector 30 and inputs and outputs a signal to and from the base sounder 20 or the fitting base 10. The alarm device-side connection terminal 32 also functions as a connecting unit to structurally connect the fire detector 30 to the base sounder 20 or the fitting base 10. Therefore, the position and the shape of the alarm device-side connection terminal 32 of the fire detector 30 are approximately the same as the position and the shape of the output device-side connection terminal 23 of the base cover 21 shown in FIG. 6. The plate 32*a* configuring the alarm device-side connection terminal 32 is sandwiched between the two plates 28*a* and 28*b* of the second output device-side connection terminal 28 of the base sounder 20 shown in FIG. 7, thereby structurally and electrically fixing the fire detector 30 to the base sounder 20. Alternatively, the plate 32*a* is sandwiched between the two plates 13*a* and 13*b* of the base-side connection terminal 13 of the fitting base 10 shown in FIG. 3, thereby structurally and electrically fixing the fire detector 30 to the fitting base 10.

The electric configuration of the base sounder 20 is explained next. FIG. 13 is a system diagram showing the electric configuration of a fire detecting system including the base sounder. As shown in the upper part of FIG. 13, a monitored region is disposed with the fitting base 10, the base sounder 20, and the fire detector 30 (the fitting base 10, the base sounder 20, and the fire detector 30 are collectively called terminal devices 40 when necessary). The terminal devices 40 are electrically connected to each other via a lead wire (a plus or minus Loop line) 2. A relay unit 4 and a receiving device 5 are connected between the terminal devices 40. As shown in an enlarged part of the terminal devices 40 at the lower part of FIG. 13, an external interlocked device 6 such as an outdoor indication lamp is connected to a remote terminal 14 provided on the fitting base 10 of each terminal device 40, when necessary.

The outline of a fire notification system is as described below. The fire detector 30 of each terminal device 40 is provided with an address inherent to the fire detector 30. The base sounder 20 of each terminal device 40 is set with an address having a constant number added to an address of the fire detector 30 connected to the base sounder 20, based on a setting at the initial system setting time. With this arrangement, a pair of addresses are set to the pair of the fire detector 30 and the base sounder 20 that are connected to each other. Specifically, at the initial starting time, the receiving device 5 transmits a control signal to the fire detector 30 to transmit the own address. The fire detector 30 receives this control signal, and transmits the own address to the receiving device 5. The receiving device 5 then transmits an address, having a predetermined number added to the address of the fire detector 30, to the base sounder 20. The base sounder 20 receives this address, and rewrites this address to the own address, thereby automatically holding the pair of addresses.

After setting the address in these manner, when it is necessary to carry out a test or a recovery or an alarm-device control, the receiving device 5 transmits a command signal, containing the addresses of the fire detector 30 and the base sounder 20 to be controlled and a command indicating the control content, to the lead wire 2. The fire detector 30 and the base sounder 20 receive this command signal, and determine whether the address contained in the command signal coincides with the address set to the self. When the address coincides with the address set to the self, the fire detector 30 and the base sounder 20 execute the command contained in the command signal.

When any fire detector 30 detects fire, this fire detector 30 outputs a fire signal containing the own address to the lead wire 2 by an interruption process. This fire signal is output to the lead wire 2 after sequentially passing through the base sounder 20 connected to the fire detector 30 and the fitting base 10. The receiving device 5 then receives this fire signal. This receiving signal 5 specifies the address of the base sounder 20 connected to the fire detector 30, based on the address of the fire detector 30 contained in the received fire signal, and outputs an alarm sound output signal containing this address to the lead wire 2.

The base sounder 20 of each terminal device 40 receives this alarm sound output signal, and determines whether the address contained in the alarm sound output signal coincides with the address set to the self. When the address contained in the alarm sound output signal coincides with the address set to the self base sounder 20, the self sounder 20 determines that the fire detector 30 connected to the self has detected fire, and outputs alarm sound having a predetermined pitch indicating this state (hereinafter, the alarm sound is referred to as fire source alarm sound). On the other hand, the base sounder 20 controls to output alarm sound having a predetermined pitch indicating this state (hereinafter, the alarm sound is referred to as linked alarm sound), to the address of the base sounder at the near address. In this case, the alarm sound output signal contains a control command to optionally control the pitch of the alarm sound, and each base sounder 20 outputs alarm sound of a pitch that coincides with this control command. Accordingly, the fire source alarm sound is output at a higher pitch than that of the linked alarm sound. When the fire detector 30 transmits a fire signal to the receiving device 5 as described above, the receiving device 5 controls to remote output to the fire detector 30, thereby operating the external interlocked devices 6 such as the outdoor display lamp connected to the fire detector 30.

The electric configuration of the base sounder that carries out the above operation is explained next in further detail. FIG. 14 is a block diagram that shows the concept of the electric configuration of the base sounder. As shown in FIG. 14, within the sounder body 22 of the base sounder 20, there are provided a power source circuit 29*a*, a transmission interface circuit 29*b*, a central control circuit 29*c*, a voltage (sound volume) control circuit 29*d*, a monitoring circuit 29*e*, and a driver circuit 29*f*, in addition to the above-described piezo element 27.

Among the above circuits, the power source circuit 29*a* is a voltage power source circuit to supply signals of a power supply of a relatively high voltage used to drive the piezo element 27, and a relatively low voltage used for the signal processing and the like. The power source circuit 29*a* is configured to include a current control function to suppress an inrush current and a noise protection function to decrease signal noise.

The transmission interface circuit 29*b* is an interface unit that fetches a pulse signal from a voltage change obtained from the lead wire 2, fetches a signal of the operation of the fire detector from the remote terminal 14, transmits these signals to the central control circuit 29*c*, and transmits a signal from the central control circuit 29*c* to the lead wire 2 in the current mode.

The central control circuit 29*c* includes a microcomputer, and a program analyzed and executed on the microcontroller, for example. The central control circuit 29*c* transmits and receives signals to and from the transmission interface circuit 29*b*, and receives an analog signal from the monitoring circuit 29*e* through an A/D (Analog/Digital) converter. The central control circuit 29*c* has a high-speed pulse output function of carrying out a pulse-width modulation (PWM), and transmits a pulse signal (PWM signal) modulated into an optional frequency and an optional pulse width, to the voltage (sound volume) control circuit 29*d* and the driver circuit 29*f*.

The voltage (sound volume) control circuit 29*d* is a switching power source regulator (a DC-DC converter) that carries out a voltage control based on the PWM signal from the central control circuit 29*c*. In other words, by voltage step-down PWM controlling the voltage (sound volume) control circuit 29*d* to operate the voltage (sound volume) control circuit 29*d* in the mode of a voltage step-down chopper regulator, the sound volume of the alarm sound of the piezo element 27 can be suppressed, and current consumption of the piezo element 27 can be suppressed. On the other hand, by voltage step-up PWM controlling the voltage (sound volume) control circuit 29*d* to operate the voltage (sound volume) control circuit 29*d* in the mode of a voltage step-up boost converter, the sound volume of the alarm sound of the piezo element 27 can increased.

The monitoring circuit 29*e* monitors whether a predetermined voltage is being applied to a load of the driver circuit 29*f* and the piezo element 27, and monitors a pulse current flowing to the load. Specifically, the monitoring circuit 29*e* reads the voltage applied to the load and the pulse current, and monitors impedance and response characteristic in the driving frequency, thereby determining whether the piezo element 27 constantly generates acousmato.

The driver circuit 29*f* is a driving unit that drives the piezo element 27 by applying a pulse signal to the piezo element 27. For example, the driver circuit 29*f* is configured as a full bridge pulse switching driver circuit having total four MOS-FETs, including two sets of two MOS-FETs of pushpull, combined together.

A pulse signal applied to the piezo element 27 and its control are explained next. FIG. 15 depicts a pulse signal. As shown in FIG. 15 (*a*), the pulse signal applied to the piezo element 27 alternately occurs at the plus side and the minus side in the same width, based on a neutral intermediate zero potential at which no current flow. This pulse signal is modulated so that the frequency and the pulse width (PW) become at predetermined values in the central control circuit 29*c*, and is input to the driver circuit 29*f*. A voltage generated by the voltage (sound volume) control circuit 29*d* and supplied to the driver circuit 29*f* is applied to the piezo element 27 in the predetermined frequency and predetermined pulse width.

In other words, the central control circuit 29*c* analyzes the control command contained in the alarm sound output signal output from the receiving device 5 shown in FIG. 13, and selects a frequency (driving frequency) of this pulse signal so that the alarm sound is output in the pitch coincided with that of this control command. For example, the central control circuit 29*c* selects a relatively high frequency to output fire source alarm sound and selects a relatively low frequency to output linked alarm sound. This selection of a frequency is carried out by selecting one frequency that coincides with the condition among plural frequencies that can be selected in advance. Flicker sound that changes over between two frequencies in a fast cycle is also generated.

When the piezo element 27 is driven in the frequency determined in this way, the central control circuit 29*c* also determines the pulse width of the pulse signal (hereinafter, the pulse width determined in this way is referred to as an optimum pulse width) so that the alarm sound is output in the highest efficiency from the piezo element 27 (so that a ratio of the output sound pressure to the consumed current becomes maximum). Specifically, because the optimum pulse width can be different for each frequency of the pulse signal, the optimum pulse width of each frequency is determined in advance based on a theoretical value or an experimental value, and the determined optimum pulse width is stored in a table of software inside the central control circuit 29*c*, in a state that each frequency is related to each optimum pulse width. After determining the frequency of the pulse signal, the central control circuit 29*c* specifies the optimum pulse width corresponding to this frequency by referencing the table, generates a pulse signal having this frequency and the optimum pulse width, and outputs this pulse signal to the driver circuit 29*f*. In other words, the central control circuit 29*c* and the driver circuit 29*f* in the present embodiment correspond to a pulse signal application unit in the claims, and the central control circuit 29*c* corresponds to a storage unit in the claims.

A relationship between the frequency and the pulse width is explained next. FIG. 16 is a graph showing a relationship between a pulse width of a pulse signal applied to the piezo element 27 in a specific frequency, a current value of the pulse signal, and an output sound pressure of alarm sound output from the piezo element 27. In FIG. 16, the horizontal axis expresses a pulse width, the right vertical axis expresses a current value, and the left vertical axis expresses an output sound pressure, with the current value denoted by a plot of X mark and the output sound pressure denoted by a square plot. This graph shows that the voltage of the pulse signal is constant, and the output sound pressure is measured in an A characteristic curve by taking a distance of 30 cm in an acoustic measuring box. When the pulse width is zero, no current flows and a neutral state is obtained, and therefore, the output sound pressure becomes zero. When the pulse width increases, the time of the intermediate potential decreases. In the maximum pulse width, the potential changes suddenly from the pulse side to the minus side, or from the minus side to the plus side. For example, in the frequency of 925 Hz, the wavelength is about 1,080 μSec. Therefore, the maximum pulse width that the pulse signal can take becomes about 540 μSec.

As shown in FIG. 16, a size of the output sound pressure to the current value changes, in a specific frequency. In the frequency shown in the graph, it is clear that when the pulse width is set to about 125±50 μSec, the current value becomes low and the output sound pressure becomes stable and high. In other words, it is known that in this specific frequency, the optimum pulse width is about 125±50 μSec. Further, by obtaining similar data in other frequency, an optimum pulse width in each frequency can be specified. By setting the optimum pulse widths in a table, and setting this table in the software within the central control circuit 29*c*, the optimum pulse width can be used in the manner as described above.

A pulse duty of the pulse signal is explained next. The central control circuit 29*c* generates a pulse signal to be applied to the piezo element 27 so that the pulse duty ratio of the pulse signal becomes less than 50%. In other words, as shown in FIG. 15, the pulse signal generated by the central control circuit 29*c* is generated so that the pulse width becomes less than one half of one wavelength (PL>2PW), thereby setting the pulse duty ratio to less than 50%. In this case, a neutral time when no pulse is being input (at the intermediate potential) is present at both the plus side and the minus side. In this neutral time, current consumption of the piezo element 27 also becomes zero.

Therefore, as shown by the conventional pulse signal in FIG. 15 (*b*), the current consumption of the piezo element 27 decreases from that when the pulse duty ratio is 50% (PL=2PW), thereby driving the piezo element 27 by saving energy. In FIG. 14, an inductor coil (not shown) is inserted in series in the piezo element 27. Therefore, the inductor coil adjusts the impedance of the piezo element 27, and discharges the energy stored in the inductor coil, during the neutral time of the switch. Consequently, the sound pressure of the piezo element 27 can be increased, and the acoustic efficiency can be further improved.

While each embodiment of the present invention has been described above, modifications and variations of specific configurations and methods of the present invention can be optionally made within the technical scope of the invention described in the claims. Such a modified example is explained below.

A specific content of the circuit configuration is optional. A part of the circuits can be replaced with a program, and a part of the function of the central control circuit 29*c* can be replaced with hardware. For example, in the embodiment, it is explained that the frequency and the optimum pulse width are set in the table, and this table is built in a program. Alternatively, a nonvolatile external storage element can be provided, and the frequency and the optimum pulse width can be stored in this external storage element. Further, in addition to the use of the stored data, the data can be fed back in real time to carry out the driving. For example, the piezo element can be driven using the optimum pulse width from the information of the impedance and the sound pressure obtained from the monitoring circuit 29*c* and the microphone.

The problems to be solved by the present invention and the effects of the present invention are not limited to the above-described content. The present invention can also solve problems not described above, and can have effects not described above. The present invention also solves only a part of the described problems, and has only a part of the effects described above. For example, even when the sound pressure at each frequency cannot be maximized, the object of the present invention can be achieved so long as when the acoustic efficiency is slightly improved from the conventional efficiency.

The circuit examples, structure examples, and the relationship of each signal and the like are simply illustrative, and these can be optionally changed unless otherwise specified.

INDUSTRIAL APPLICABILITY

As described above, the sounder according to the present invention can be used to give alarm based on the output from the alarm device. Particularly, the sounder according to the present invention is useful to output the alarm at high efficiency.

The invention claimed is:

1. A sounder that outputs alarm sound to notify an abnormality in a monitored region, the sounder comprising:

a sound source that outputs alarm sound when a pulse signal is applied to the sound source;

a pulse signal application unit that applies the pulse signal to the sound source; and a storage unit that stores a plurality of combinations of a frequency and a pulse width that the pulse signal can take, wherein the pulse signal application unit generates the pulse signal so that the pulse signal corresponding to the combination of the frequency and the pulse width stored in the storage unit is applied to the sound source, and the pulse signal application unit intermittently applies the pulse signal that alternately occurs at a plus side and a minus side based on a neutral intermediate zero potential at which no current flow.

2. The sounder according to claim 1, wherein when the frequency of the pulse signal is determined by a predetermined method, the pulse signal application unit obtains a pulse width corresponding to the determined frequency from the storage unit, and generates the pulse signal so that the pulse signal of the determined frequency and the obtained pulse width is applied to the sound source.

3. The sounder according to claim 1, wherein the pulse signal application unit generates the pulse signal so that the pulse duty ratio of the pulse signal becomes less than 50%.

4. The sounder according to claim 2, wherein the pulse signal application unit generates the pulse signal so that the pulse duty ratio of the pulse signal becomes less than 50%.

5. A fire detecting system comprising;

an alarm device that detects an abnormality in a monitored region;

a sounder that outputs alarm sound to notify the abnormality in the monitored region; and a receiving device that is connected to the alarm device and the sounder, wherein, the alarm device outputs a fire signal to the receiving device when the alarm device detects the abnormality in the monitored region, the receiving device outputs an alarm sound output signal to the sounder when the receiving device receives the fire signal from the alarm device, the sounder determines a pitch of alarm sound based on the alarm sound output signal when the sounder receives the alarm sound output signal from the receiving device, and outputs alarm sound of the pitch determined based on the alarm sound output signal, wherein, the receiving device outputs the alarm sound output signal that contains a control command to control the pitch of alarm sound, and the sounder determines the pitch of alarm sound based on the control command that is contained in the alarm sound output signal received from the receiving device.

6. The fire detecting system according to claim 5, wherein, the sounder comprises a sound source that outputs alarm sound when a pulse signal is applied to the sound source, and a pulse signal application unit that applies the pulse signal to the sound source, wherein the pulse signal application unit selects a frequency of the pulse signal based on the control command so that the alarm sound is output in the pitch coincided with that of the control command.

7. The fire detecting system according to claim 6, wherein, the sounder comprises a storage unit that stores a plurality of combinations of a frequency and a pulse width that the pulse signal can take, wherein the pulse signal application unit select one of the plurality of combinations stored in the storage unit based on the frequency selected based on the control command, and determines the pulse width of the pulse signal based on the one of the plurality of combinations selected based on the frequency.

8. The fire detecting system according to claim 7, wherein, the pulse signal application unit intermittently applies the pulse signal that alternately occurs at a plus side and a minus side based on a neutral intermediate zero potential at which no current flow.

* * * * *